US006454670B1

(12) United States Patent
Beers

(10) Patent No.: US 6,454,670 B1
(45) Date of Patent: Sep. 24, 2002

(54) SWING PRACTICING APPARATUS

(76) Inventor: Michael Beers, 9903 Inca La., Austin, TX (US) 78733

( * ) Notice: Subject to any disclaimer, the term of this patent is extended or adjusted under 35 U.S.C. 154(b) by 195 days.

(21) Appl. No.: 08/972,640

(22) Filed: Nov. 18, 1997

(51) Int. Cl.[7] ..... A63B 69/00
(52) U.S. Cl. ..... 473/451; 473/422
(58) Field of Search ..... 473/416, 422, 473/423, 451, FOR 102, FOR 169, 417, 453, 278, FOR 103; 446/396, 325; 482/85, 83, 90

(56) References Cited

U.S. PATENT DOCUMENTS

| | | | | | |
|---|---|---|---|---|---|
| 1,020,367 | A | * | 3/1912 | Patterson | 482/85 |
| 1,394,669 | A | * | 10/1921 | DaCosta | 446/326 |
| 2,037,508 | A | * | 4/1936 | Gilman | 473/444 |
| 2,184,453 | A | * | 12/1939 | Hayes | 482/90 |
| 2,272,765 | A | | 2/1942 | Beeson et al. | 273/29 |
| 2,282,766 | A | | 5/1942 | Miremont | 273/58 |
| 2,458,306 | A | * | 1/1949 | Schneider | 273/450 |
| 2,499,743 | A | * | 3/1950 | Goodman | 446/325 |
| 2,527,906 | A | | 10/1950 | Bennett et al. | 273/26 |
| 2,577,343 | A | | 12/1951 | Martin | 46/130 |
| 2,713,487 | A | | 7/1955 | Jaediker | 273/29 |
| 2,937,872 | A | | 5/1960 | Gilman | 273/55 |
| 3,442,045 | A | * | 5/1969 | Green | 446/297 |
| 3,858,878 | A | * | 1/1975 | Tassone | 473/423 |
| 3,877,697 | A | * | 4/1975 | Lersch | 473/417 |
| 4,176,838 | A | * | 12/1979 | Griffin | 473/417 |
| 4,268,030 | A | * | 5/1981 | Richards | 482/85 |
| 4,438,927 | A | | 3/1984 | Hefler | 273/90 |
| 4,486,016 | A | * | 12/1984 | Rubin | 482/90 |
| 4,770,412 | A | * | 9/1988 | Wolfe | 482/85 |
| 4,830,371 | A | * | 5/1989 | Lay | 473/423 |
| 4,854,587 | A | | 8/1989 | Groves | 273/26 R |
| 4,938,478 | A | * | 7/1990 | Lay | 473/423 |
| 5,035,424 | A | * | 7/1991 | Liao | 473/423 |
| 5,393,050 | A | | 2/1995 | Lloyd | 273/29 A |
| 5,685,788 | A | * | 11/1997 | Shy et al. | 473/423 |

FOREIGN PATENT DOCUMENTS

| | | |
|---|---|---|
| CH | 566 151 | 9/1975 |
| FR | 462.082 | 1/1914 |
| JP | 03184572 | 12/1981 |

* cited by examiner

*Primary Examiner*—Jessica Harrison
*Assistant Examiner*—John M Hotaling, II
(74) *Attorney, Agent, or Firm*—Baker Botts L.L.P.

(57) ABSTRACT

A swing practicing device trains a hitter, such as a baseball batter, to improve the accuracy and power of his swing. A target is coupled to the terminal end of a target support, the target accepting swing impacts without separating from the target support. The target support extends from a base having a rounded bottom surface, the curves of the rounded surface in rotational engagement with the ground. Swing impacts at the target cause the apparatus to rotate from an upright position to a more horizontal position and then return to the upright position to accept repeated swing impacts. The device can include an inflatable air bladder within the target and target support, and can include an adjustable weight for its base. The device can also include an adjusting mechanism to adjust the vertical height of the target.

21 Claims, 2 Drawing Sheets

SWING PRACTICING APPARATUS

TECHNICAL FIELD OF THE INVENTION

This invention relates in general to a swing practicing apparatus, and more particularly to a baseball swing practicing apparatus for improving swing power and precision.

BACKGROUND OF THE INVENTION

Hitting a baseball well requires precise timing and a powerful swing. To improve their baseball swing, baseball players must practice their swing mechanics repeatedly. Although players can practice swing mechanics by actually playing the game of baseball, other practicing techniques are necessary because of the very nature of the game. In baseball, a pitcher tries to throw the ball into a strike zone in an unpredictable way to prevent the batter from hitting the pitch. Thus, hitting each actual pitch can require a slightly different swing and does not necessarily reinforce desired swing mechanics. Further, the process of playing a baseball game is time-consuming and can require a large playing area. Thus, the game of baseball itself is not conducive to the repetitious practicing needed to optimize swing mechanics.

A variety of methods and devices have evolved over the years to support practicing of a baseball swing in an efficient yet expeditious manners. For instance, players can practice their swing in a batting cage by receiving nearly identical pitches from an automatic pitching machine. Alternatively, players can practice a baseball swing by hitting a baseball from a tee. Both of these practicing techniques help to improve a player's hand-eye coordination, but hitting an actual baseball does not significantly improve the power of a player's swing without extensive repetition. Further, hitting an actual ball can reduce the number of repetitions which a player can achieve due to the time needed to chase down and recover the hit balls. Also, hitting an actual ball for practice generally needs a large playing area or a restraint to catch the balls after they are hit. Thus, practice involving the hitting of an actual ball generally is restricted to fair weather.

Some methods and devices allow practice with fixed targets. One technique employed by coaches to improve the power of a swing is to have a player repeatedly hit a suspended tire. Hitting a suspended tire improves swing power by absorbing the energy of a swing but does nothing to improve the player's hand-eye coordination. Mechanical targets, such as that disclosed in U.S. Pat. No. 5,035,424 issued to Liao, have been devised to offer a fixed target to a hitter, but existing devices are complicated and have moving parts which can break off to destroy the device and cause injury to the hitter or a nearby observer.

SUMMARY OF THE INVENTION

Therefore, a need has arisen for a swing practicing apparatus which will absorb swing energy to provide improved swing power while providing a target small enough to practice hand-eye coordination for improved swing precision.

In accordance with the present invention, a swing practicing apparatus is provided that substantially reduces disadvantages and problems associated with previously developed apparatus for swing improvement. A target support extends from a base, the target support having a terminal end. The base has a rounded bottom surface for rotational engagement with the ground. A target is coupled to the terminal end of the target support. A hitter can swing at the target to practice and improve the hitter's swing power and precision. The target accepts the swing impact without separating from the target support. The impact forces the base to rotate along the rounded surface from an initial upright position to a more horizontal position. The weight distribution of the apparatus then biases the apparatus to rotate along the rounded surface back to the upright position.

More specifically, the target and target support are comprised of a durable, energy-absorbing material for absorbing swing impacts, such as nylon reinforced rubber similar to the material found in automotive tires. The target support and target can include an inflatable bladder in their interior, the inflatable bladder providing improved support for accepting swing impacts. The base can incorporate a weight sufficiently heavy to bias the base to an upright position. The weight can comprise a replaceable substance, such as sand or lead pellets, which can be stored in a cavity in the base.

In one embodiment, an adjusting mechanism can be incorporated in the base and target support for adjusting the vertical height of the target when the apparatus is in an upright position. The adjusting mechanism can comprise a first thread incorporated with the target support and a second thread associated with the base. The threads cooperate to adjust the vertical height of the target by rotating the target support relative to the base. The first thread can be formed in the interior of the base, with the target support having the second thread incorporated in its exterior surface so that the target support screws into the base. The target support and base can be locked into a fixed position by filling the air bladder.

The present invention provides important technical advantages for practicing swing mechanics to improve a swing. For instance, the present invention provides an automatically repeating target which can allow a hitter to repeatedly practice his swing without resetting the target after each swing.

Another important technical advantage is the simple and virtually indestructible construction of the present invention which allows the absorption of repeated swings without breaking or falling apart.

Another important technical advantage of the present invention is its construction with minimal or no moving parts, and especially metal parts, which can break loose upon swing impact to cause injury to the hitter or observers nearby.

Another important technical advantage is that the present invention can be used indoors in limited space to allow batting practice during inclement weather.

Another important technical advantage of the present invention is that it allows a hitter to practice and improve hand-eye coordination and swing power simultaneously.

BRIEF DESCRIPTION OF THE DRAWINGS

A more complete understanding of the present invention and advantages thereof may be acquired by referring to the following description taken in conjunction with the accompanying drawings in which like reference numbers indicate like features and wherein.

DETAILED DESCRIPTION OF THE INVENTION

Preferred embodiments of the present invention are illustrated in the figures, like numerals being used to refer to like and corresponding parts of the various drawings.

The swing practicing device according to the present invention provides an automatically repeating target for batting practice which can improve both the power of the batter's swing and the batter's hand-eye coordination. The automatically repeating target is accomplished with a rounded and weighted base that is in rotational engagement with the ground. When the base is knocked over by the impact of a swing, it automatically rights itself and stands ready for another swing.

Figure 1:
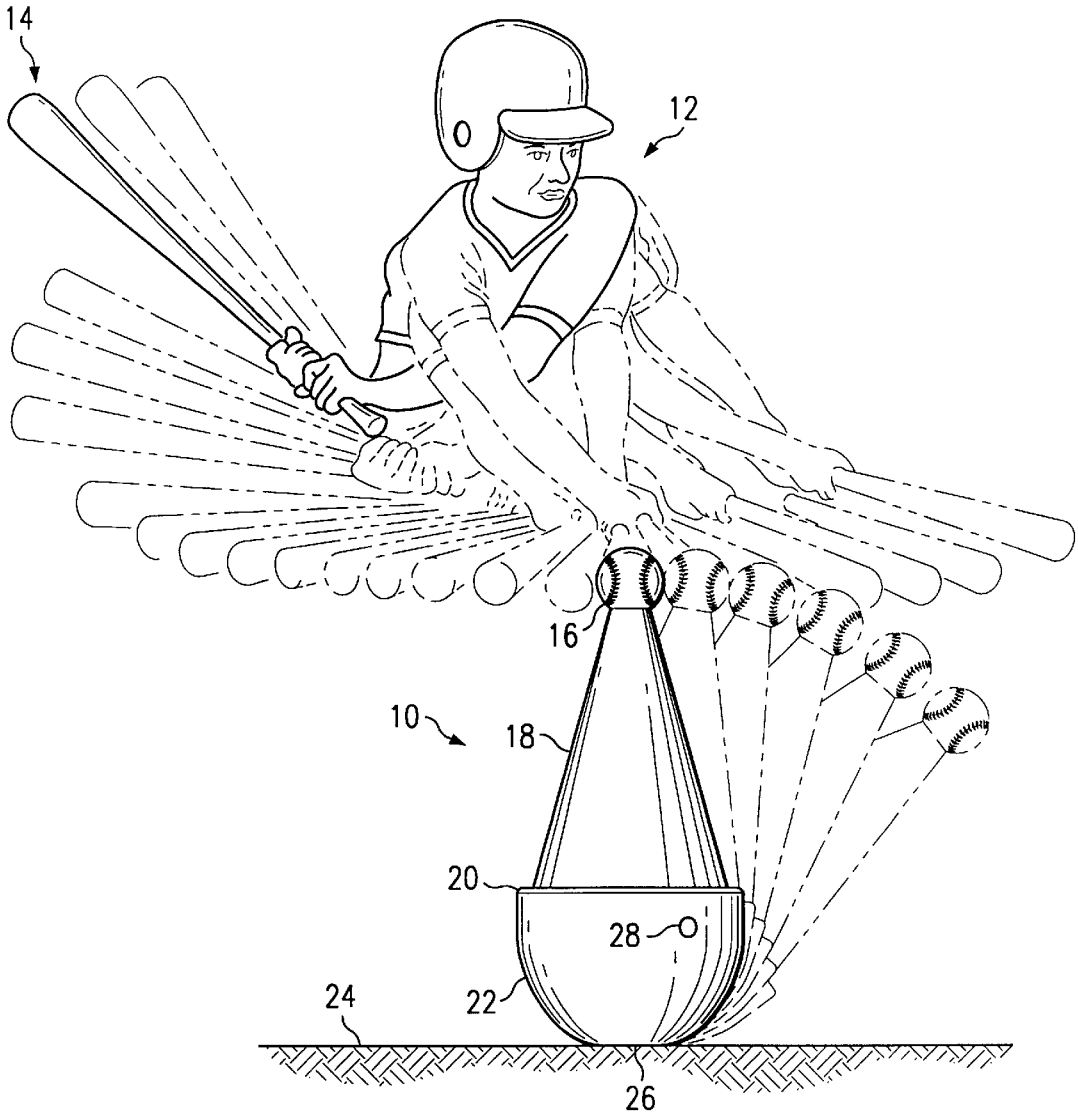
FIG. 1 depicts a side view of a hitter swinging at one embodiment of the present invention.

Referring now to FIG. 1, one embodiment of an apparatus 10 according to the present invention is depicted being used by a batter 12 swinging a baseball bat 14. Batter 12 directs the swing so that bat 14 impacts target 16, which is formed in the shape of a baseball. Target 16 absorbs the impact of the swing and translates the energy of the impact through a target support 18 to a base 20. Target 16, target support 18 and base 20 rotate from the initial upright position existing at the time of impact towards a more horizontal position, and then return to the upright position to allow batter 12 to repeat his swing at target 16.

Base 20 has a rounded bottom 22 that is in resting engagement with the ground 24. In one embodiment, base 20 has a flat bottom 26 to minimize movement of apparatus 10 prior to receiving a swing impact. Rounded bottom 22 has curves extending from the flat bottom 26 of base 20 to the top of base 20. Base 20 can include an opening 28 to allow for the addition of weight to base 20. For instance, sand or lead pellets can be added to a cavity formed within base 20 through opening 28 to adjust the effect of a swing impact on the movement of target 16 towards a horizontal position. The addition of weight to base 20 allows for absorption of a more powerful swing impact with less movement towards a horizontal position, and provides a greater bias to rotate target 16 to an upright position.

Target 16, target support 18, and base 20 can be constructed of 0.125 inch thick nylon reinforced rubber similar to the material used to construct automotive tires. Alternative materials can be used if the materials are sufficiently tough enough to absorb repeated swing impacts without allowing the target to separate from the target support. Target 16, target support 18 and base 20 can be formed as one piece, or as plural pieces coupled together by any conventional means. Preferably, the construction will avoid the use of metal parts which can break off and cause injury, although a metal weight can be incorporated within base 20 to increase the bias of base 20 to an upright position.

Figure 2:
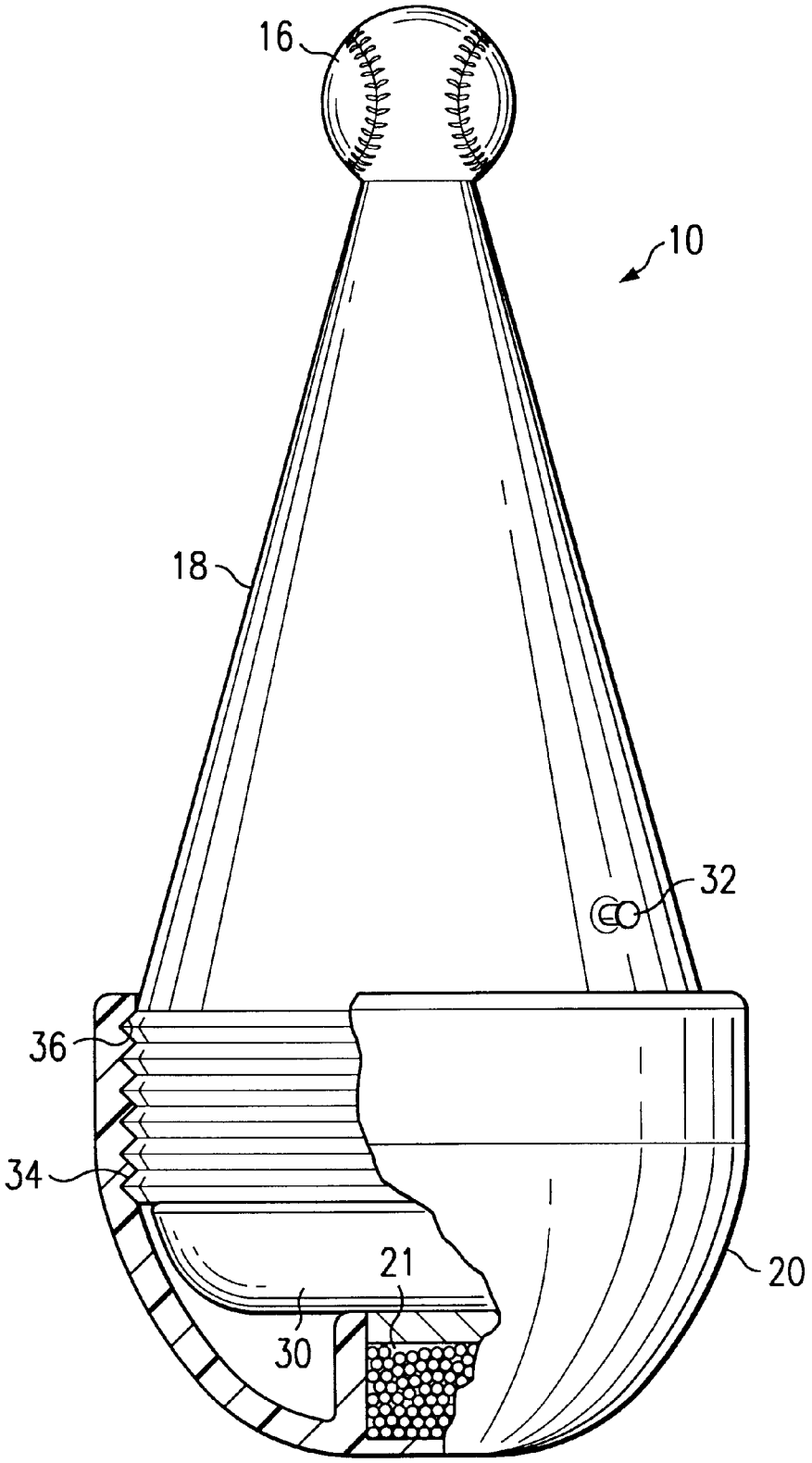
FIG. 2 depicts a cutaway view of an apparatus according to the present invention which incorporates an adjusting mechanism for adjusting the vertical height of the target.

Referring now to FIG. 2, a swing practicing device according to the present invention is depicted in cutaway view. A cavity 21 is depicted in base 20 for accepting additional weight. An inflatable bladder 30 is located in the interior of target support 18. Bladder 30 can be formed by the solid walls of target support 18, or can be a separate device similar to the innertube of an automobile or bicycle tire. Bladder 30 can accept air through inflation point 32, which can use any conventional means of accepting and holding air. The air in bladder 30 helps target support 18 maintain sufficient rigidity during swing impacts to translate impact energy into rotational motion. In alternative embodiments, the target support and base can each have an independent and separate air bladder. An air bladder in the target can adjust the effect which an impact has by changing the target energy absorption characteristics. Further, when the target 16 and target support 18 are formed as a contiguous unit, bladder 30 can extend into a cavity common to both target 16 and target support 18.

FIG. 2 depicts a partial cutaway view of apparatus 10 to illustrate an adjusting mechanism for adjusting the vertical height of target 16 when target 16 is in an upright position in preparation for accepting a swing impact. Target support 18 can include an exterior thread 34 and base 20 can include an interior thread 36, each thread formed in a spiral similar to a screw thread. Alternatively, target support 18 can be coupled securely to base 20 by any conventional means including construction of support 18 and base 20 as a single contiguous unit.

In an embodiment of the present invention that includes a target height adjusting mechanism, target 16 is coupled to a target support 18 having a thread 34 disposed on its exterior surface. Target support 18 is placed into base 20 to engage interior thread 36 of base 20. The vertical height of target 16 is adjusted by rotating target support 18 relative to base 20 to engage threads 36 and 34 at an appropriate height. After the target height is adjusted to a predetermined level, the position of base 20 and target support 18 can be locked relative to each other by filling air bladder 30. Air bladder 30 experts pressure against target support 18 to create a force against threads 34 and 36. The amount of locking force can be increased by increasing the air pressure in bladder 30.

In operation, swing practicing device 10 is set up in an upright position on its base 20. Weight, such as sand or lead, is added to base 20 through opening 28 which is then closed off and secured. Alternatively, weight is added by unscrewing target support 18 from base 20 to expose a weight compartment 21, and then secured by reattaching target support 18 to base 20. The batter or his coach can adjust the weight added to cavity 21 according to the amount of power of the anticipated swing impact. The batter or coach can also adjust the vertical height of target 16 with the adjusting mechanism according to the height of a proper swing for the batter.

Once swing practicing device 10 is properly set up, a batter can swing at target 16 with full power. Target 16 absorbs the impact of the batter's swing and translates the energy of the swing through target support 18 to base 20 so that the curved edge of rounded bottom 22 rotates in engagement with the ground from the upright position to a more horizontal position. During the rotation, the energy of the swing is dissipated and the weight in base 20 biases target 16 to return to the upright position. The hitter or his coach can judge the characteristics of the swing by observing the direction which target 16 takes and the amount of vertical displacement by target 16.

Target 16 is firmly coupled to target support 18 so that swing impacts will not separate target 16 from target support 18. Thus, a batter can repeat his swing repeatedly without chasing target 16 after each swing. Further, the weight and rounded portion of base 20 can be adapted to allow a batter to swing at target 16 when target 16 is in motion towards the upright position to the more horizontal position. In alternative embodiments, target 16 could be shaped to support any hitting sport, such as softball, tennis or racquetball.

Although the present invention has been described in detail, it should be understood that various changes, substitutions and alterations can be made hereto without departing from the spirit and scope of the invention as defined by the appended claims.

What is claimed is:

1. A swing practicing device comprising:

a base having a rounded bottom;

a target support extending from the base to a terminal end;

an inflatable bladder located in an interior of the target support, the inflatable bladder formed by inner walls of the target support; and a baseball shaped target coupled to the target support at the terminal end, the target for accepting swing impacts from a baseball bat without separating from the target support.

2. The device according to claim 1 wherein the target comprises an inflatable bladder.

3. The device according to claim 1 wherein the base comprises a weight to bias the target to an upright position for accepting swing impacts.

4. The device according to claim 3 wherein the base has a cavity for storing the weight and an opening for accepting the weight.

5. The device according to claim 4 wherein the weight comprises sand.

6. The device according to claim 3 wherein the target support has a height corresponding to the vertical height of the target in the upright position, the target support further comprising an adjusting mechanism for adjusting the vertical weight of the target.

7. The apparatus according to claim 1 wherein the target comprises nylon reinforced rubber.

8. A baseball swing practicing apparatus comprising:

a base having a top and bottom, the bottom having curved edges for rotational engagement with the ground, the base further having a cavity for storing a weight, the weight for biasing the base towards an upright position;

a target support coupled to the base, the target support having a terminal end, the terminal end a vertical height above the ground;

an inflatable bladder associated with the target support, the inflatable bladder operable to lock the vertical height of the target support; and a target fixed coupled to the terminal end, the target having a baseball shape.

9. The apparatus according to claim 8 wherein the target support and the target compose a single air bladder.

10. The apparatus according to claim 8 further composing an adjusting mechanism for adjusting the vertical height of the target.

11. The apparatus according to claim 10 wherein the adjusting mechanism comprises a first thread associated with the target support and a second thread associated with the base, the threads cooperating to adjust vertical height of the target.

12. A method for practicing a baseball swing comprising the steps of:

swinging a baseball bat at a target, the target fixedly coupled to a support, the support having a rounded bottom;

impacting the target with the baseball bat, the target having an inflatable bladder operable to adjust an effect of the impact by changing energy absorption characteristics of the target; and absorbing the impact of the swing with the support by allowing the rounded bottom of the support to rotationally engage the ground.

13. The method according to claim 12 wherein the target comprises a baseball shape.

14. The apparatus according to claim 8 further comprising the inflatable bladder formed by inner walls of the target support.

15. The apparatus according to claim 8 further comprising the inflatable bladder formed by an innertube located in an interior of the target support.

16. A self-righting swing practicing device comprising:

a base having a top and a bottom, the bottom designed for rotational engagement with the ground;

a conical-shaped target support having a larger end and a smaller end, the larger end coupled proximate the top of the base and the smaller end forming a terminal end;

an inflatable bladder located in an interior of the conical-shaped target support; and a baseball shaped target coupled to the terminal end and operable to accept swing impacts from a baseball bat without separating from tile conical-shaped target support.

17. The self-righting swing practicing device of claim 16 further comprising the baseball shaped target including an inflatable bladder.

18. The self-righting swing practicing device of claim 16 further comprising a weight coupled to the base, the weight operable to bias the target in a position for accepting swing impacts.

19. The self-righting swing practicing device of claim 18 further comprising the base including a cavity for storing the weight, the cavity including an opening for receiving the weight therein.

20. The self-righting swing practicing device of claim 16 further comprising:

an adjustment mechanism operably coupling the base and the conical-shaped target support; and the adjustment mechanism operable to displace the conical-shaped target support with respect to the base such that varying swing practice heights may be achieved.

21. The self-righting swing practicing device of claim 16 further comprising the baseball shaped target including nylon reinforced rubber.

* * * * *